US007963710B2

(12) United States Patent
Kobayashi et al.

(10) Patent No.: US 7,963,710 B2
(45) Date of Patent: Jun. 21, 2011

(54) LABEL PRINTER

(75) Inventors: Kenji Kobayashi, Tokyo (JP); Akira Dangami, Tokyo (JP)

(73) Assignee: Lintec Corporation, Tokyo (JP)

( * ) Notice: Subject to any disclaimer, the term of this patent is extended or adjusted under 35 U.S.C. 154(b) by 941 days.

(21) Appl. No.: 11/909,230

(22) PCT Filed: Mar. 14, 2006

(86) PCT No.: PCT/JP2006/304979

§ 371 (c)(1),
(2), (4) Date: Sep. 20, 2007

(87) PCT Pub. No.: WO2006/100962

PCT Pub. Date: Sep. 28, 2006

(65) Prior Publication Data

US 2009/0028622 A1 Jan. 29, 2009

(30) Foreign Application Priority Data

Mar. 22, 2005 (JP) ..... 2005-081392

(51) Int. Cl.
*B41J 15/00* (2006.01)

(52) U.S. Cl. ..... 400/613; 229/80.5; 229/92; 156/387

(58) Field of Classification Search ..... 400/613; 156/384–388; 229/80.5, 92–92.3, 92.8
See application file for complete search history.

(56) References Cited

U.S. PATENT DOCUMENTS

| | | | | |
|---|---|---|---|---|
| 5,155,973 | A * | 10/1992 | Hipko et al. | 53/452 |
| 5,429,576 | A * | 7/1995 | Doderer-Winkler | 493/214 |
| 5,466,321 | A * | 11/1995 | Miyaji | 156/260 |
| 5,524,421 | A * | 6/1996 | Nauheimer et al. | 53/460 |
| 6,786,263 | B1 | 9/2004 | Fox, Jr. et al. | |
| 7,090,114 | B1 * | 8/2006 | Katz | 229/92.8 |
| 7,762,301 | B2 * | 7/2010 | Mathea | 156/378 |
| 2005/0006445 | A1 * | 1/2005 | Katz | 229/92.8 |
| 2006/0096710 | A1 * | 5/2006 | Tsukamoto et al. | 156/384 |
| 2010/0218900 | A1 * | 9/2010 | Norrby | 156/387 |

FOREIGN PATENT DOCUMENTS

| | | | |
|---|---|---|---|
| JP | 2597332 | B2 | 4/1997 |
| JP | 10-198273 | A | 7/1998 |
| JP | 2001-114234 | A | 4/2001 |
| JP | 2001-246882 | A | 9/2001 |
| JP | 2002-014617 | A | 1/2002 |

* cited by examiner

OTHER PUBLICATIONS

English Translation of JP 04366625 Dec. 1992.* International Search Report of PCT/JP2006/304979, date of mailing Jun. 27, 2006.

*Primary Examiner* — Ren Yan
*Assistant Examiner* — Allister Primo
(74) *Attorney, Agent, or Firm* — Westerman, Hattori, Daniels & Adrian, LLP

(57) ABSTRACT

The printer includes a printing unit 12 that performs printing on each of a label L1 and a second raw sheet M2 on the way of feeding out a first raw sheet M1, which is temporarily stuck with labels L1 on a release liner S, and a second raw sheet M2 having no adhesive layer; a peeling unit 13 that peels off the label L1 from the release liner S; first and second holding units 15, 16 that hold a label sheet L2 formed via a cutting unit 14; and a laminating unit 17 that laminates the label L1 and the label sheet L2 with each other so that the reverse surface of the printed surface of the label sheet L2 faces the adhesive layer side of the label L1 are provided. The label L1 laminated with the label sheet L2 is stuck onto an adherend W in a state that the adhesive layer is exposed in a closed loop state in an entire area of the periphery of the label sheet L2.

8 Claims, 8 Drawing Sheets

LABEL PRINTER

FIELD OF THE INVENTION

The present invention relates to a label printer, in particular to a label printer suitable for laminating a label sheet having no adhesive layer onto an adhesive layer side of a label to stick the label sheet in a state being sandwiched between the label and an adherend.

BACKGROUND OF THE ART

Recently, accompanying a global expansion of Internet, TV shopping and the like, mail-order sale has come into wide use in addition to a conventional over-the-counter sale. Accordingly, logistics models in which a delivery agent delivers an article in place of a seller have been widespread. For this reason, there is a possibility that information about an article, for example, article name, price of the article or the like may be leaked out through a delivery slip. Such information specifies the article purchased by a consumer, which is confidential information seriously affecting the privacy of the consumer. Since the price of the article has such feature that the value of the article can be comprehended, the price of the article is preferably regarded as a piece of confidential information in view of theft proof in the process of logistics.

In this respect, when the delivery slip has such a structure that a plurality of sheets of forms is laminated and stacked into a bundle, the article name, sum of the money to be received and the like are described in a part of the delivery slip and the article can be handed over to the consumer in a state that the confidentiality is ensured. However, when a delivery slip of this type is employed, available label printer therefor is limited.

To eliminate such restrictions on the printer, a sheet type delivery slip can be employed, in which confidential information to be concealed from others also comes to be seen from the outside.

The patent document 1 discloses a label usable as a sheet type delivery slip. The label is a sheet type label including a confidential information form portion continuous with an open information form portion. The label is arranged in such a way that the confidential information form portion is turned-back to the rear face side of the open information form portion, and the open information form portion is stuck to an adherend, and thereby the confidential information form portion is concealed from the outside.

Also, the patent document 2 discloses a label printer capable of printing on both sides of a label.

[Patent document 1] Japanese Patent Application Laid-Open No. 2001-246882

[Patent document 2] U.S. Pat. No. 6,786,263

DISCLOSURE OF THE INVENTION

Problem to be Solved by the Invention

However, the label set forth in the patent document 1 has a disadvantage that a manual process to fold back the label is needed. Also, an adhesive layer is not exposed in the entire area of peripheral of the label folded back to the rear surface side thereof, but the adhesive layer is exposed only in a partial area thereof. That is, an area along a folding edge of the label is left in a state being unstuck to the adherend, which causes the peripheral part of stuck label to float up or to wave partially, and thereby resulting in an unintended peel-off of the label.

The printer set forth in the patent document 2 has such an arrangement that the printing is carried out on an adhesive layer of a label. Therefore, so called no-adhesive-treatment is carried out in which adhesive layer is not formed in the portions to be printed, while a processing to form holes in the portions to be printed on a release liner is needed. Further, each time an area to be printed is changed, the no-adhesive-treatment portions in the label have to be changed. Therefore, there is a disadvantage that the degree of freedom of printing area becomes restricted.

Object of the Invention

The present invention has been proposed in view of the above disadvantages. It is an object of the present invention to provide a label printer capable of automatically laminating a label sheet with a plane area smaller than the label onto an adhesive layer side of the label and suitable for sticking the label sheet in a state that confidential information printed thereon is concealed between an adherend and the label.

Another object of the present invention is to provide a label printer capable of printing on both sides of the label without performing any special treatment on the adhesive layer of the label.

Means for Solving Problems

To achieve the above objects, a label printer according to the present invention employs such an arrangement that includes: a support means that supports a first raw sheet temporarily stuck with labels on one surface of a release liner and a second raw sheet having no adhesive layer, so as to be capable of feeding out; a printing means that performs printing on the labels and second raw sheet on the way of feeding out; a peeling means that peels off the label from the release liner; a cutting means that cuts the second raw sheet to a smaller plane area than the plane area of the label to form a label sheet; a first and a second holding means that hold the label that has been peeled off by the peeling means and the label sheet; and a laminating means that laminates the label and the label sheet so that an adhesive layer side of the label faces the reverse side of the printed surface of the label sheet.

The present invention may employ such an arrangement that the label sheet is laminated onto the label so that an adhesive layer of the label is exposed in a closed loop state in the periphery area of the label sheet.

Also, such an arrangement is employed that the first holding means is arranged so as to be supported by a drive unit and movable forward and backward with respect to a predetermined adherend, and when the first holding means is pressed against the adherend, the label sheet is stuck being sandwiched between the label and the adherend via the adhesive layer exposed in the periphery side of the label sheet.

Further, each of the first and second holding means is provided with a corresponding first suction plate and a second suction plate respectively, and the second suction plate is arranged so as to be movable forward and backward along a feed-out direction of the label sheet.

Furthermore, such an arrangement is employed that when the second suction plate moves to the upstream side in the feed-out direction and sucks an area corresponding to the label sheet, the cutting means cuts the second raw sheet substantially along the edge of the second suction plate at the upstream side in the feed-out direction.

Still further, such an arrangement is preferably employed that a tear-off line is formed within the surface of the label for permitting the label to be partially torn off in a state being laminated with the label sheet.

Still furthermore, a notch is preferably formed in a predetermined portion along the tear-off line, and the notch forms a turning-over section after the label sheet has been stuck in a state being sandwiched between the label and the adherend.

Further, a suction face of the second holding means is arranged to be substantially the same with or smaller than the outer shape of the label sheet.

Effect of the Invention

According to the label printer of the present invention, since the label sheet is formed so that the plane area thereof is smaller than that of the label, and after laminating the label sheet onto the adhesive layer side of the label, the label sheet can be stuck to the adherend being sandwiched between the label and the adherend, the entire peripheral area of the label can be adhered to the adherend. Therefore, the label can be effectively prevented from partial floating of the peripheral portion thereof after being stuck, and the information printed on the label sheet can be completely concealed.

Also, since the second suction plate is provided so as to move forward and backward along the feed-out direction of the label sheet, positional adjustment along the feed-out direction becomes possible when sticking the label sheet to the adhesive layer side of the label. Moreover, since the second raw sheet is cut along the edge of the second suction plate at the upstream side in the feed-out direction, the entire area of the label sheet can be sucked by the second suction plate.

Moreover, provision of the tear-off line and the notch formed within the surface of the label allows the label sheet to be torn off easily together with a part of the label, and the turning-over section can be used when tearing off the label sheet.

Still moreover, since the suction face of the second holding means has a shape that is substantially the same with or smaller than the external shape of the label sheet, the second holding means is prevented from being stuck with the adhesive of the label.

EXPLANATION OF REFERENCE NUMERALS

Figure 1:
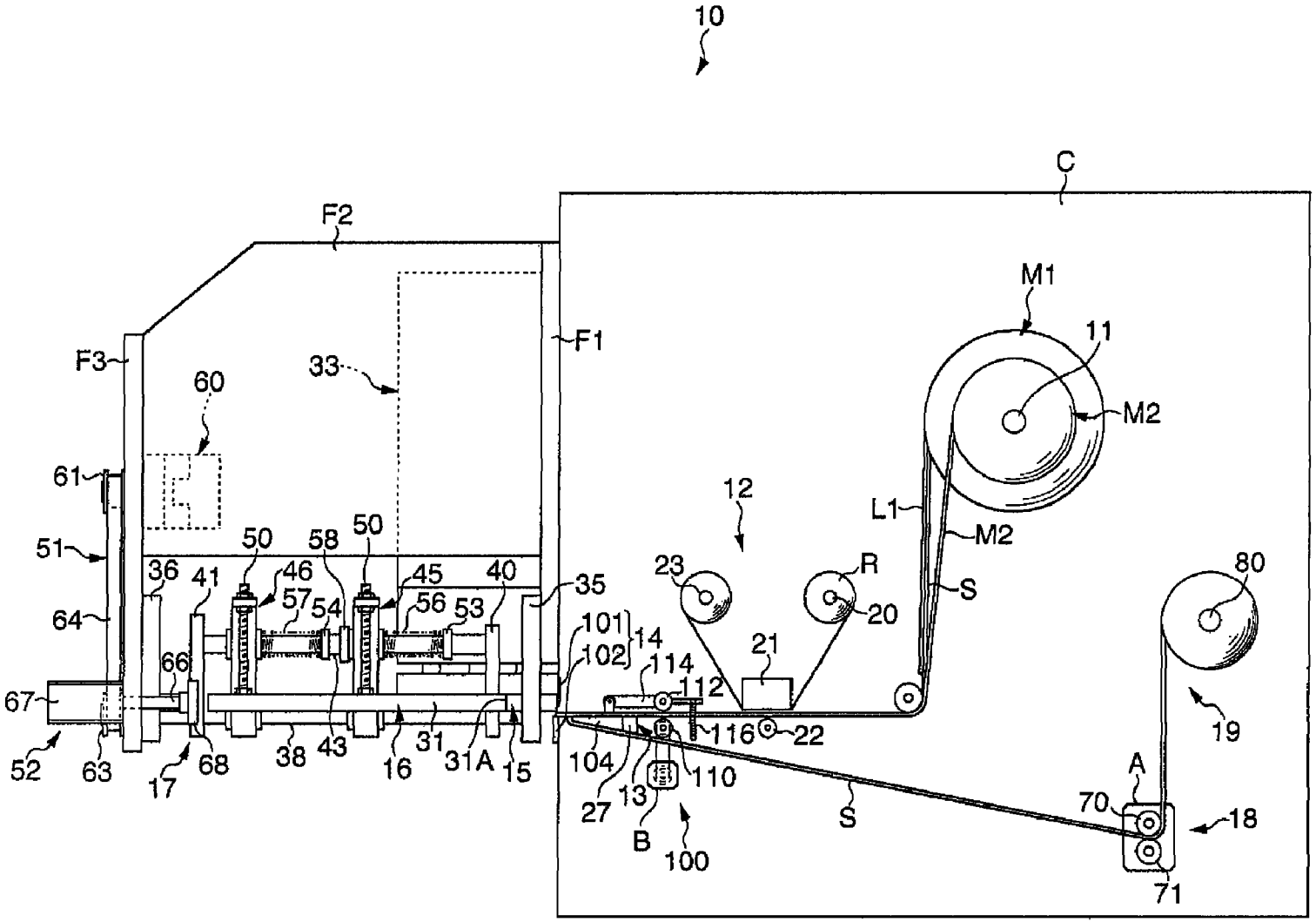
FIG. 1 is a schematic front view of a label printer according to an embodiment of the present invention.

10: Label printer
11: Support roll (Support means)
12: Printing means
13: Peeling means
14: Cutting means
15: First holding means
16: Second holding means
17: Laminating means
27: Peel plate
30: First suction plate
31: Second suction plate
33: Cylinder unit (Drive unit)
52: Forward/backward movement device
L1: Label
L2: Label sheet
M1: First raw sheet
M2: Second raw sheet
S: Release liner

BEST MODE FOR CARRYING OUT THE INVENTION

Referring now to the drawings, an embodiment of the present invention will be described bellow.

Figure 2:
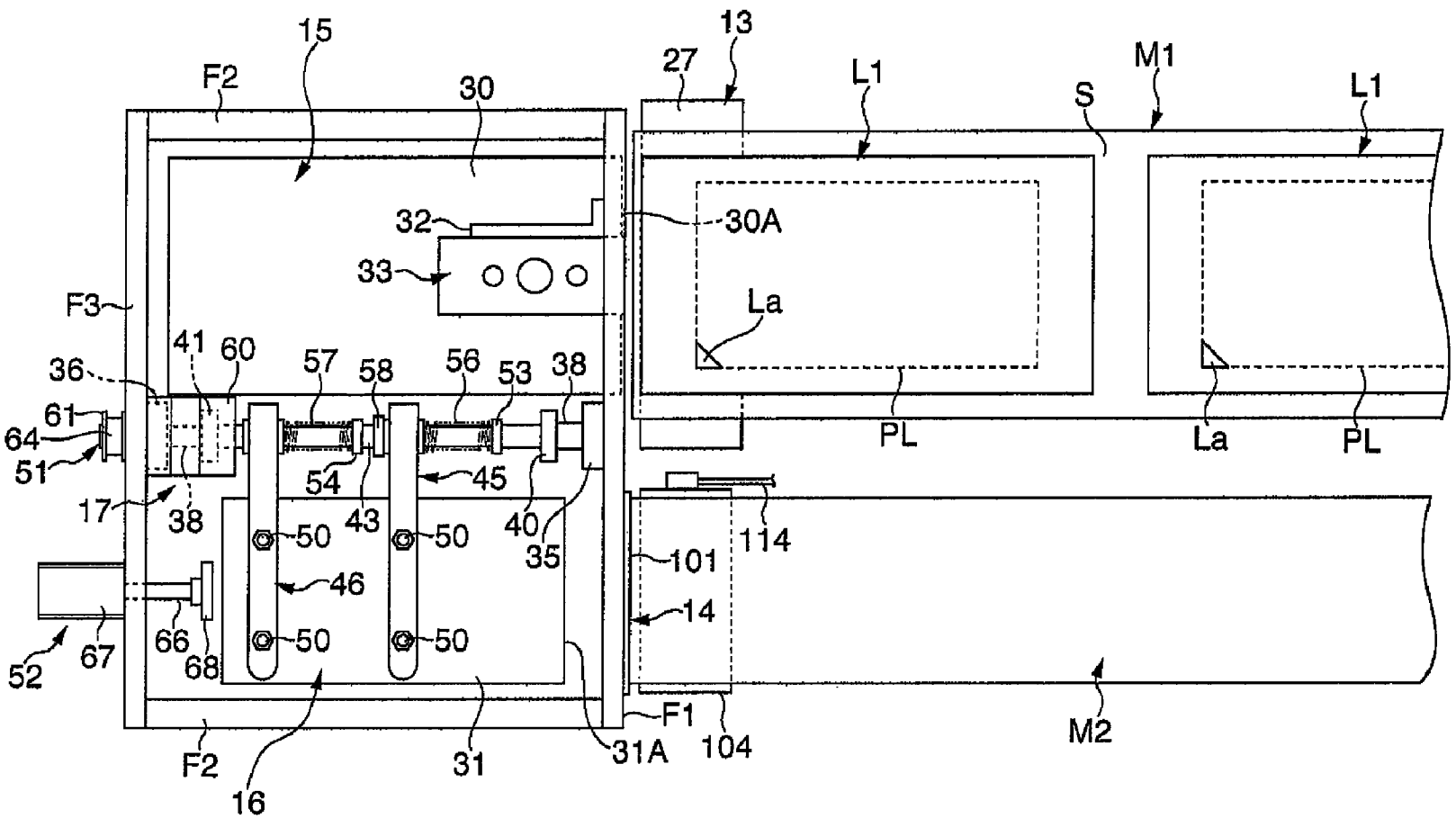
FIG. 2 is a schematic plane view of an essential portion of the label printer.
Figure 3:
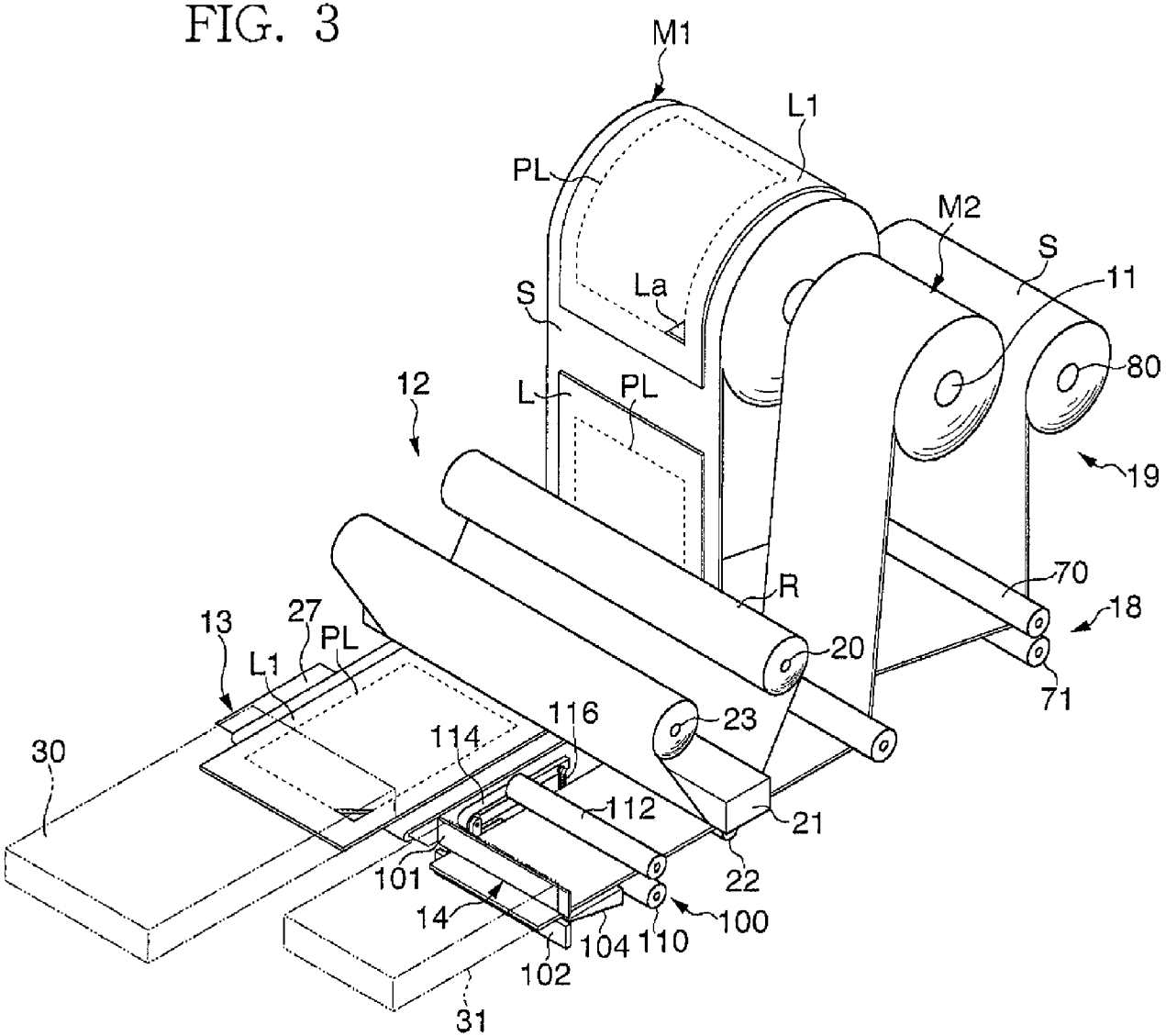
FIG. 3 is a schematic perspective view of a part of the label printer.

FIG. 1 shows a schematic front view of a label printer according to an embodiment of the present invention, and FIG. 2 shows a schematic plan view thereof. FIG. 3 shows a schematic perspective view of a part of the label printer. In these figures, a label printer 10 includes: a printer case C; a support roll 11 being provided within an area of the printer case C and functioning as a support means that supports a first raw sheet M1 in which labels L1 are temporarily stuck onto one surface of a release liner S having a strip-like shape via an adhesive layer (not shown), and a second raw sheet M2 composed of a strip of plain paper, heat sensitive paper or the like, in a coaxial manner so as to feed out the both therefrom; a printing means 12 that performs printing on the label L1 and the second raw sheet M2 on the way of feeding of the first and second raw sheets M1, M2; a peeling means 13 that peels off the label L1 from the release liner S; a cutting means 14 that cuts the second raw sheet M2 into a smaller area than the plane area of the label L1 to form a label sheet L2; a first holding means 15 that holds the label L1 peeled-off by the peeling means 13 and a second holding means 16 that holds the label sheet L2; a laminating means 17 that laminates the label L1 and the label sheet L2 so that the reverse side of the printed surface of the label sheet L2 faces the adhesive layer side of the label L1; a first feeding force imparting means 18 that imparts feeding force to the first raw sheet M1, a second feeding force imparting means 100 that imparts feeding force to the second raw sheet M2, and a winding means 19 that winds the release liner S from which the label L1 has been peeled. In the printer case C, a discharge port (not shown) is formed for discharging the label L1 and the second raw sheet M2 through the forward part of the peeling means 13 (left side in FIG. 1).

As shown in FIG. 2 and FIG. 3, in the embodiment, such a first raw sheet M1 is employed that has the labels L1 temporarily stuck on one surface of a release liner S at predetermined intervals along an extending direction thereof. The first raw sheet M1 is produced by forming half-cuts corresponding to the shape of the label L1 at predetermined intervals on a strip of a label base material, which has the same width as that of the release liner S, and then peeling off a label base material portion at the peripheral side of the labels L1 as refuse. Note that the printing can be also carried out while forming the labels L1 by providing a die cut unit for forming the half-cut and a refuse winder inside of the label printer 10.

The second raw sheet M2 is provided so as to have a smaller width (specifically, almost the same width as that of perforations, which will be described later), than that of the label L1 (a width in the vertical direction in FIG. 2), and is cut to a feed-out length (specifically, almost the same length as that of the perforations along the feed-out direction, which will be described later), that is shorter than that of the label L (a length in a lateral direction in FIG. 2) by the cutting means 14, and thereby the label sheet L2 that has a smaller plane area than that of the label L1 is formed.

As shown in FIG. 2, within the surface of the label L1, perforation PL as a tear-off line that substantially corresponds to the outer shape and size of the label sheet L2 is formed. The perforation PL allows an inner area excluding the periphery portion of the label L1 to be torn off together with the label sheet L2, after the label L1 and label sheet L2 are laminated with each other so that the reverse side of the printed surface (lower surface in FIG. 3) of the label sheet L2 faces the rear surface or the adhesive layer side of the label L1. Note that a continuous half-cut may be formed instead of the perforation PL. Also, in a corner area of the perforation PL, a turning-over section La formed by cutting off a part of the label L1 is provided, by which turning-over operation is carried out easily when tearing off the inner area of the label L1 together with label sheet L2 along the perforation PL. In the embodiment, in a case where the object is a home delivery article, on the label L1, for example, information which does not require to be concealed such as receiver's address or the like of the article is printed, while on the label sheet L2, confidential information which should not be opened, for example, article name, price of the article or the like is printed.

The printing means 12 is provided with a ribbon holder roll 20 that holds an ink ribbon R wound in a roll-like shape, a printing head 21 on which the ink ribbon R fed out from the ribbon holders roll 20 is laid around to perform printing of predetermined information, a platen roll 22 opposing to the printing head 21, a ribbon winding roll 23 for the ink ribbon R, and a drive unit (not shown) that drives to rotate the ribbon winding roll 23. The printing head 21 according to the embodiment includes a thermal head that performs printing on the label L1 and the second raw sheet M2 using the ink ribbon R. However, in a case where the label L1 and the second raw sheet M2 are arranged to be heat sensitive paper, the ink ribbon R is not necessary. Also, in place of the thermal head, an ink jet printer, a laser printer or the like may also be employed.

The peeling means 13 includes a peel plate 27 disposed at the downstream side of the first raw sheet M1 in the feed-out direction with respect to the printing head 21, and is arranged to sharply turn over the first raw sheet M at the front end of the peel plate 27 to peel off the label L1 from the release liner S.

The cutting means 14 includes a cutter blade 101 movable in a direction perpendicular to the surface of the second raw sheet M2; i.e., in the vertical direction in FIG. 1, and a cutter table 102 disposed opposing to the front end (lower end) of the cutter blade 101. The cutter blade 101 is arranged to be movable substantially along the upstream side edge of a second suction plate (which will be described later) in the feed-out direction, and thereby the label sheet L2 is ensured not to protrude from a suction face of the second suction plate. At the upstream side of the feed-out direction with respect to the cutting means 14, a guide plate 104 is disposed that feeds out the second raw sheet M2 on a substantially flat surface.

Figure 5:
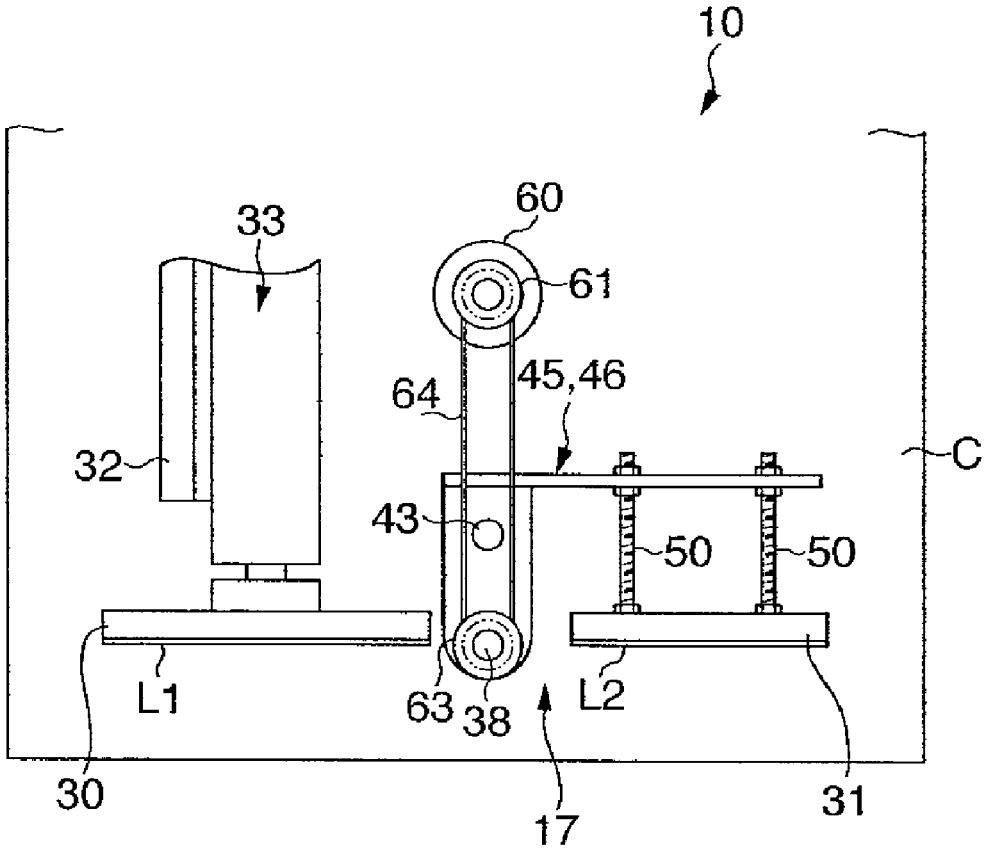
FIG. 5 is a schematic side view of the label printer.
Figure 5:
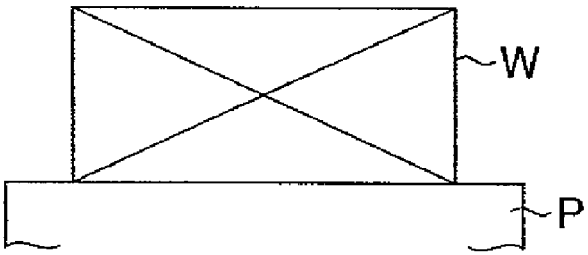

The first and second holding means 15, 16 include first and second suction plates 30, 31 having suction faces, which have plane areas substantially equal to those of the label L1 and the label sheet L2 at the lower surface side thereof. The first and second suction plates 30, 31 are disposed in a lower portion of and between a rear frame F1 fixed to a front end face (left end face in FIG. 1) of the printer case C and a front frame F3 coupled with the rear frame F1 via coupling frames F2, F2. Here, the first suction plate 30 is disposed such that the rear end 30A thereof extends backward (rightward in FIG. 1) than a lower end of the rear frame F1 and reaches a position very close to the front end of the peel plate 27. The first suction plate 30 is supported by a cylinder unit 33 as a drive unit fixed to the rear frame F1 within the surface thereof via a bracket 32, and is arranged so as to move upward and downward with respect to the upper surface of the adherend W passing through in a lower portion thereof along a conveyance path P (refer to FIG. 5).

The second suction plate 31 is supported between the rear frame F1 and the front frame F3 interposing the laminating means 17 therebetween. The laminating means 17 includes a pair of bearing plates 35, 36 each fixed to the lower and opposing faces of the rear frame F1 and the front frame F3 respectively; a rotary shaft 38 that extends between the lower portions of the bearing plates 35, 36 and has such a length that the front end side thereof (left end side in FIG. 1) penetrates and extends forward through the bearing plate 36; a pair of turning-shaft fixing plates 40, 41 that are fixed to the rotary shaft 38 and located inner side between the bearing plates 35, 36; a turning shaft 43 fixed between the upper parts of the turning-shaft fixing plates 40, 41; a first arm 45 and a second arm 46 each having a substantially L-like shape in side view and fixed in a state of bridging between the turning shaft 43 and the rotary shaft 38; a plurality of bolts 50 that are located between the first and second arms 45, 46 and the second suction plate 31, and connects the second suction plate 31 to the first and second arms 45, 46; a rotary-driving device 51 that imparts a rotary force to the rotary shaft 38; and a forward/backward movement device 52 that moves the second suction plate 31 forward and backward along the feed-out direction.

The turning shaft 43 is provided with ring-like spring receiving members 53, 54 fixed to the first and second arms 45, 46 respectively at the right side thereof in FIG. 1. Between the spring receiving members 53, 54 and the first and second arms 45, 46, coil springs 56, 57 are provided respectively whereby the first and second arms 45, 46 are biased in a forward direction of the turning shaft 43 (leftward in FIG. 1). On the other hand, the first arm 45 is arranged so that the movement thereof is restricted by a stopper 58 fixed in substantially central area of the turning shaft 43 to stop at an initial position; i.e., at a position where the label sheet L2 sucked by the second suction plate 31 is stuck inside the perforations PL of the label L1.

The rotary-driving device 51 includes a rotary actuator 60 fixed to the front frame F3 at the rear face (inner face) side thereof an upper pulley 61 fixed to an output shaft of the rotary actuator 60; a lower pulley 63 fixed to the front end of the rotary shaft 38; and a timing belt 64 laid around between the upper and lower pulleys 61, 63. The rotary-driving device 51 is arranged so that, when the rotary actuator 60 is activated, the rotary shaft 38 becomes rotatable, and around the rotary shaft 38 as the rotation center, the first and second arms 45, 46 rotate together with the turning shaft 43; thereby the second suction plate 31 fixed to the first and second arms 45, 46 can turn to the bottom face side of the first suction plate 30 with reversing the upper and lower faces of the second suction plate 31.

Figure 4:
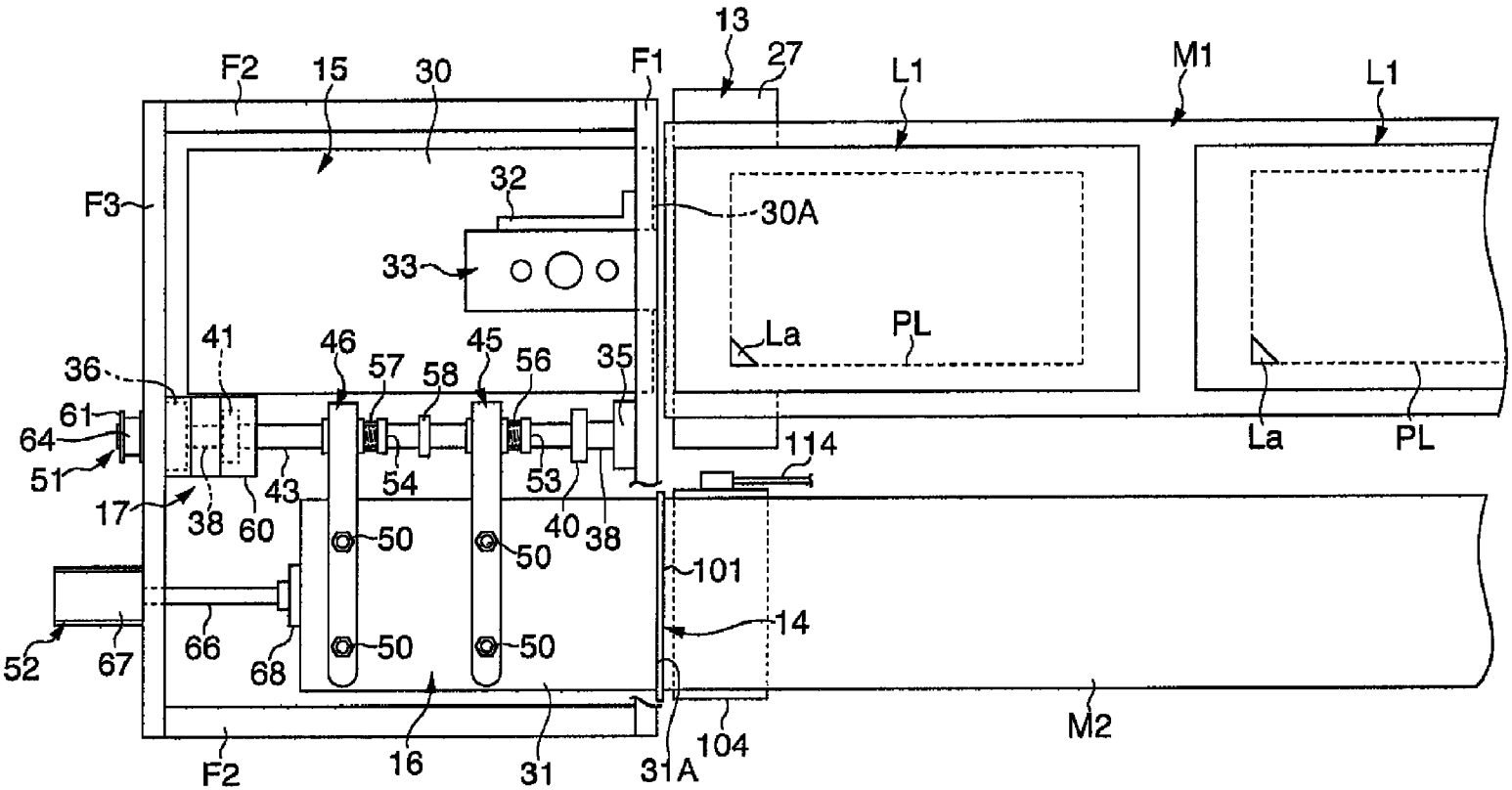
FIG. 4 is a schematic plan view of an essential portion showing a state that a second label suction plate has moved to a peel plate side.

The forward/backward movement device 52 includes an air cylinder 67 fixed to the front face of the front frame F3, a piston rod 66 of which is disposed penetrating the front frame F3 and extending to the inside of the front frame F3; and an contact pad 68 fixed to the front end of the piston rod 66 and being in contact with the front end face of the second suction plate 31. The forward/backward movement device 52 is arranged so as, when the piston rod 66 protrudes, to move the second suction plate 31 backward toward the cutter blade 101 against the biasing force of the coil springs 56 and 57 as shown in FIG. 4, and thereby to position the rear end 31A of the second suction plate 31 on a substantially same line as the vertical surface of the cutter blade 101. On the other hand, the second suction plate 31 is arranged so as, when the piston rod 66 is positioned at a retracted position, to return to an initial position thereof by the biasing force of the coil springs 56, 57.

The first feeding force imparting means 18 includes a drive roll 70; a pinch roll 71 that nips the release liner S between the drive roll 70 and the same, and a motor A that drives to rotate the drive roll 70.

The winding means 19 includes a winding roll 80 that holds the lead end of the release liner S and winds the release liner S. The winding roll 80 has a rotary shaft (not shown) protruded to the rear face side of the printer case C, and the rotary shaft is coupled with the output shaft of the motor A constituting the first feeding force imparting means 18 so as to be driven via power transmitting means (not shown) such as pulleys, a belt and the like, and whereby the release liner S can be wound.

The second feeding force imparting means 100 includes a drive roll 110 positioned at the lower surface side of the second raw sheet M2 in FIG. 1, a motor B for driving to rotate the drive roll 110 via pulleys, a belt or the like, and a pinch roll 112 positioned above the drive roll 110 for pinching the second raw sheet M2. The pinch roll 112 is rotatably supported at one end side of arm 114 and the other end side of arm 114 is rotatably supported by a side edge portion of the guide plate 104. The pinch roll 112 is biased toward the drive roll 110 by a coil spring 116.

Hereinafter, referring to FIGS. 5 through 9 additionally, overall operation of the embodiment is described. For the convenience of description, it is assumed herein that an adherend W is a home-delivery article, and on the label L1 and the label sheet L2, relevant information including delivery destination of the article is printed.

When a predetermined printing information is input in advance through an input unit and a control unit (not shown), and when the motor A of the first feeding force imparting means 18 and the motor B of the second feeding force imparting means 100 are driven to rotate, the first raw sheet M1 and the second raw sheet M2 are fed out, and the winding operation of the release liner S constituting the first raw sheet M1 is started. At this time, the second suction plate 31 positioned at the initial position (refer to FIG. 2) is moved toward the cutter side together with the first and second arms 45, 46 against the biasing force of the coil springs 56, 57 due to a press force of contact pad 68 driven by the air cylinder 67, which constitutes the forward/backward movement device 52 (refer to FIG. 4). Thereby the first and second suction plates 30, 31 get ready to suck and hold the label L1 and the label sheet L2 with the entire suction faces respectively.

The information input previously is printed on the label L1 and the second raw sheet M2 while passing through the printing head 21. When printing, non-confidential information such as receiver's address and name, sender's address and appellation, or the like are printed on the label L1. On the other hand, on the second raw sheet M2, for example, confidential information such as amount of money to be received corresponding to the price of the article, article description, date and the like is printed so as to function as a receipt. Depending on the article, there may be a case that sender's name is indicated using an anonym. In such a case, sender's name may be printed on the second raw sheet M2 as confidential information.

The printed label L1 is peeled off at the front end of the peel plate 27 and the label L1 is sucked and held by the first suction plate 30. On the other hand, when the printed second raw sheet M2 has passed the position of the cutter blade 101 by a distance equivalent to the length of the perforation PL in a right-left direction in FIG. 1, the second raw sheet M2 is cut by the cutter blade 101, and the label sheet L2 thus formed is sucked and held by the second suction plate 31 (refer to FIG. 5).

When the label L1 and label sheet L2 are sucked by the suction plates 30, 31 respectively, a piston rod 66 of the air cylinder 67 is retracted, and accompanying this, the contact pad 68 moves toward the air cylinder 67. Consequently, the first and second arms 45, 46 are moved along the axial lines of the rotary shaft 38 and the turning shaft 43 by the biasing force of the coil springs 56, 57, and the second suction plate 31 held by the shafts is accordingly returned to the initial position (refer to FIG. 2).

Figure 6:
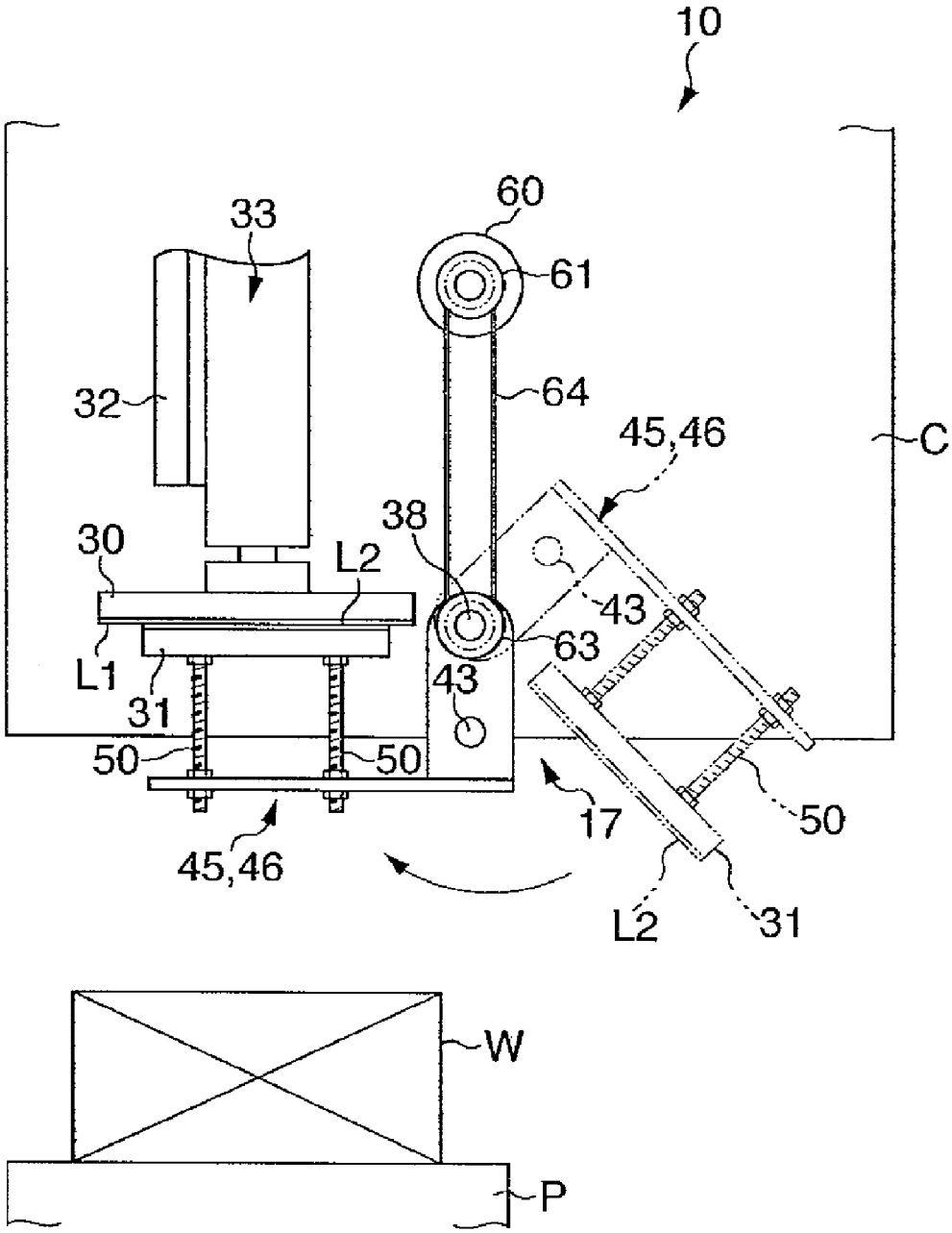
FIG. 6 is a schematic side view showing a state that the second label suction plate has turned to the lower surface side of a first label suction plate.
Figure 7:
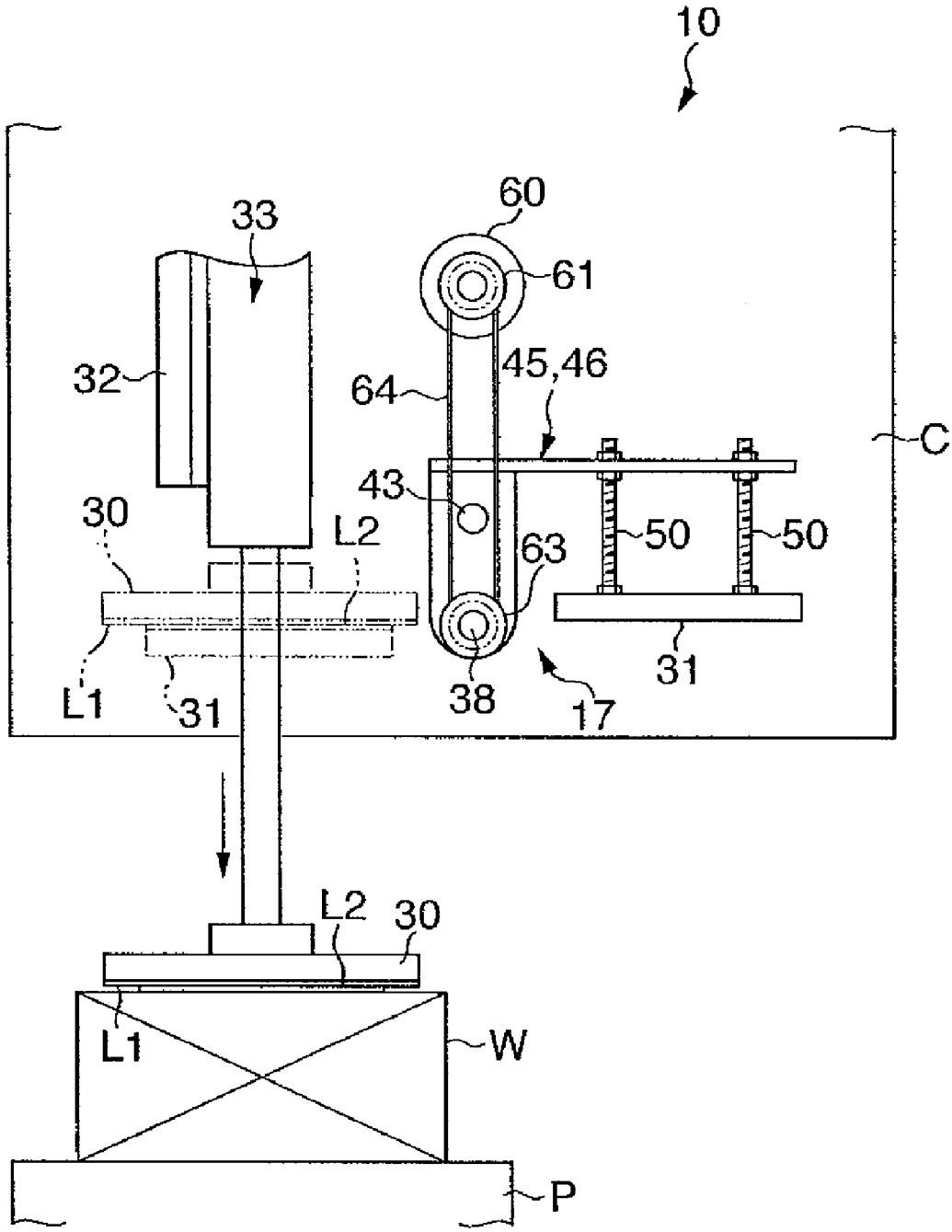
FIG. 7 is a schematic side view showing a state that first and second labels are stuck to an adherend in a state being laminated with each other.

Then, as shown in FIG. 6, the rotary actuator 60 of the rotary-driving device 51 is actuated to rotate and the rotary shaft 38 rotates via pulleys 61, 63 and the timing belt 64; whereby the turning shaft 43, the first and second arms 45, 46 and the second suction plate 31 are integrally rotated in the clockwise direction in FIG. 6 via the turning-shaft fixing plates 40, 41, which are, fixed to the rotary shaft 38. The rotation angle is substantially 180°. Owing to this arrangement, the second suction plate 31 is rotated to a position substantially parallel to the first suction plate 30; and thus the label L1 and the label sheet L2 are laminated with each other with the reverse side of the printed surface of the label sheet L2 facing the adhesive layer of the label L1. Accordingly, the adhesive layer of the label L1 is exposed in a closed loop state in the peripheral area of the label sheet L2.

Figure 8:
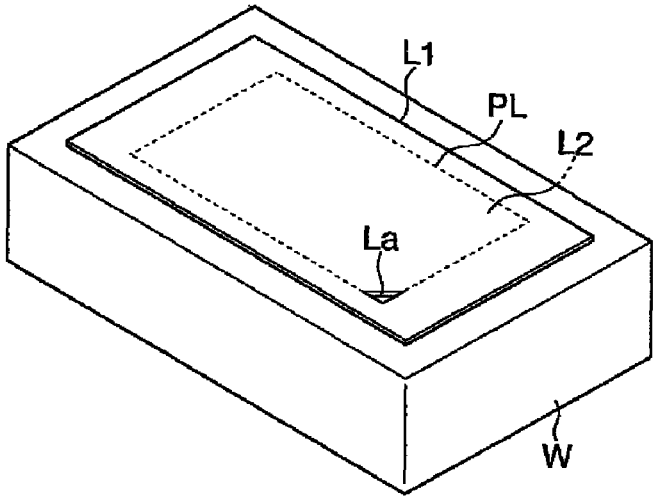
FIG. 8 is a schematic perspective view showing a state that the label has been stuck to the adherend.
Figure 9:
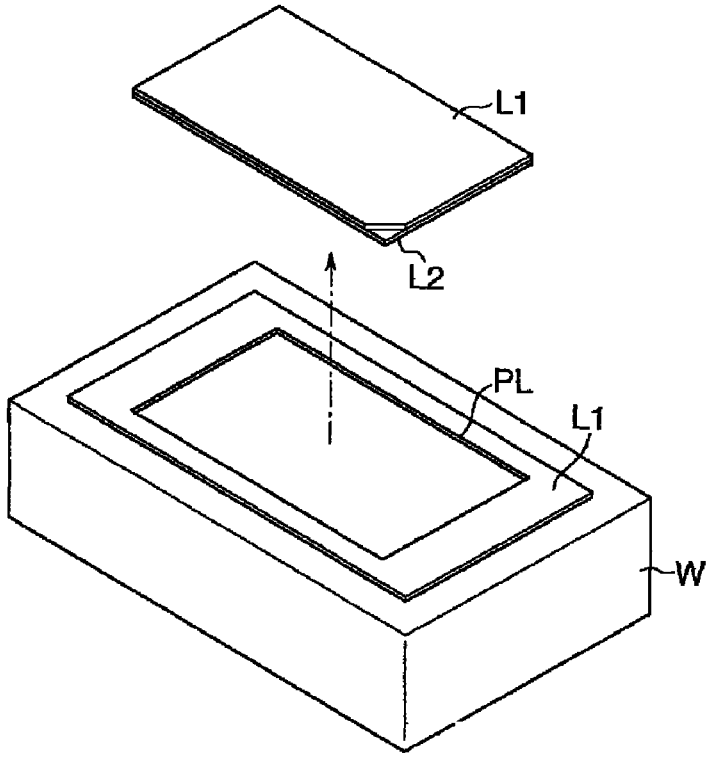
FIG. 9 is a schematic perspective view showing a state that an inner area of the label stuck to the adherend is torn off along perforation.

When the laminating has completed, the second suction plate 31 returns to the initial position (refer to FIG. 7), and the first suction plate 30 is moved downward via the cylinder device 33 and pressed against the surface of the adherend W standing by below the first suction plate 30, thereby the adhesive layer of the label L1 is stuck onto the surface of the adherend W in a state that the label sheet L2 is sandwiched between the label L1 and the adherend W (refer to FIG. 8). In this state, the adhesive layer of the label L1 is stuck to the entire area around the periphery of the label sheet L2, resulting in that there is not any floating up portion in the periphery of the stuck label L.

The inner portion enclosed by the perforations PL of the label L1 stuck to the adherend W can be torn off. At that time, by nipping the turn over portion La with tips of fingers and pulling up the same, the entire area within the perforations PL can be turned over (refer to FIG. 8, FIG. 9). Thus, the information printed on the label sheet L2 can be confirmed, and the label sheet L2 can be stored, if necessary.

Consequently, according to the embodiment as described above, such a label printer can be provided that performs printing using a sheet type label and has a function to stick the label to an adherend in a state that confidential information is concealed. Also, owing to the adhesive layer of the label formed in a closed loop state, the stuck label does not include any area which is not stuck in the periphery thereof; and thus, unintended turn over or peel-off can be prevented thereafter.

The best arrangement and method for carrying out the present invention have been disclosed so far. However, the present invention is not limited to the above.

That is, the present invention has been illustrated and described mainly about a specific embodiment. However, it is possible for those skilled in the art to add various modifications, if necessary, to the above-described embodiment with respect to the shape, position and/or disposition without departing from the technical spirit and the range of the object of the present invention.

For example, the perforations PL of the label L1 applied to the present invention is not limited to the examples of illustrated arrangements, but the perforations capable of dividing into smaller pieces may be adopted. In that case, when the label sheet L2 is also formed with similar perforations, the number of peeling off units from the adherend W can be arranged to be plural.

Also, in the label sheet L2, a notch portion may be formed in an area where the turn over portion La is located. This arrangement will facilitate the turn over operation when the inner area of the label L1 is torn off together with the label sheet L2 along the perforations PL.

Also the plane configuration of the label L and the label sheet L2 is not limited to a square shape, but various plane configurations such as a polyangular, circular, elliptical shape may be regarded as an object. In other words, as long as the label can be printed and stuck to the adherend in a state that confidential information is concealed, and also the adhesive layer of the label L1 is exposed around the entire periphery of the label sheet L2, various design change is possible.

Moreover, in the embodiment, the suction face of the second suction plate 31 has been arranged to have substantially the same area as the plane area of the label sheet L2; i.e., the external shape of the label sheet L2. However, the suction face of the second suction plate 31 may be arranged to be smaller than the label sheet L2.

The invention claimed is:

1. A label printer, comprising:

a support means that supports a first raw sheet temporarily stuck with labels on one surface of a release liner and a second raw sheet having no adhesive layer so as to be capable of feeding out;

a printing means that performs printing on each of said labels and second raw sheet on a way of feeding out said each raw sheet;

a peeling means that peels off the labels from said release liner;

a cutting means that cuts said second raw sheet to a plane area smaller than a plane area of said label to form a label sheet;

a first and a second holding means that hold the label which has been peeled off by said peeling means, and the label sheet; and a laminating means that laminates said label and label sheet so that an adhesive layer side of said label faces a reverse side of a printed surface of the label sheet.

2. The label printer according to claim 1, wherein said label sheet is laminated onto said label so that an adhesive layer of the label is exposed in a closed loop state in a periphery area of the label sheet.

3. The label printer according to claim 1 or 2, wherein said first holding means is arranged so as to be supported by a drive unit and movable forward and backward with respect to a predetermined adherend, and when the first holding means is pressed against the adherend, said label sheet is stuck being sandwiched between said label and the adherend via the adhesive layer exposed in the periphery side of the label sheet.

4. The label printer according to claim 1 or 2, wherein each of said first and second holding means is provided with a corresponding first suction plate and a second suction plate respectively, and the second suction plate is arranged so as to be movable forward and backward along a feed-out direction of said label sheet.

5. The label printer according to claim 4, wherein when said second suction plate moves to the upstream side in said feed-out direction and sucks an area corresponding to said label sheet, said cutting means cuts the second raw sheet substantially along the edge of said second suction plate at the upstream side in said feed-out direction.

6. The label printer according to claim 1 or 2, wherein a tear-off line is formed within the surface of said label for permitting the label to be partially torn off in a state being laminated with said label sheet.

7. The label printer according to claim 6, wherein a notch is formed in a predetermined portion along said tear-off line, and wherein the notch forms a turning-over section after said label sheet has been stuck in a state being sandwiched between said label and the adherend.

8. The label printer according to claim 1 or 2, wherein a suction face of said second holding means is substantially the same with or smaller than the outer shape of said label sheet.

* * * * *